US007322108B2

(12) United States Patent
Caldwell

(10) Patent No.: US 7,322,108 B2
(45) Date of Patent: Jan. 29, 2008

(54) HAIR CUTTING DEVICE

(75) Inventor: Melissa Claire Caldwell, Wellington (NZ)

(73) Assignee: Innovations International Limited, Wellington (NZ)

( * ) Notice: Subject to any disclaimer, the term of this patent is extended or adjusted under 35 U.S.C. 154(b) by 740 days.

(21) Appl. No.: 10/312,133

(22) PCT Filed: Jun. 22, 2001

(86) PCT No.: PCT/NZ01/00117

§ 371 (c)(1),
(2), (4) Date: Dec. 19, 2002

(87) PCT Pub. No.: WO01/97647

PCT Pub. Date: Dec. 27, 2001

(65) Prior Publication Data

US 2003/0106220 A1 Jun. 12, 2003

(30) Foreign Application Priority Data

Jun. 22, 2000 (NZ) ..... 505381
Oct. 5, 2000 (NZ) ..... 507336

(51) Int. Cl.
*B26B 21/04* (2006.01)

(52) U.S. Cl. ..... 30/49; 30/50; 30/507

(58) Field of Classification Search ..... 30/49, 30/50, 347, 356, 526, 507, 514
See application file for complete search history.

(56) References Cited

U.S. PATENT DOCUMENTS 3,241,236 A * 3/1966 Capps ..... 30/287
3,491,725 A * 1/1970 Maniscalco ..... 119/625
4,020,549 A * 5/1977 Edwards ..... 30/30
4,254,680 A * 3/1981 Gauthier ..... 83/665
4,432,138 A * 2/1984 Piccolo, Jr. ..... 30/294
4,498,237 A 2/1985 Mack et al.
4,541,405 A * 9/1985 Schlough ..... 125/23.01
4,899,444 A 2/1990 Trichell et al.
4,970,990 A 11/1990 Wilhelmi
5,131,863 A 7/1992 Gerke et al.
D338,083 S * 8/1993 Fogel et al. ..... D28/52
5,568,688 A 10/1996 Andrews
5,898,999 A 5/1999 Chaouachi et al.

(Continued)

FOREIGN PATENT DOCUMENTS

EP 220850 5/1987

(Continued)

*Primary Examiner*—Timothy V. Eley
(74) *Attorney, Agent, or Firm*—Workman Nydegger

(57) ABSTRACT

A hand-held dressing device has a blade with a sharpened cutting edge. The blade is preferably V- or U-shaped and permanently or removably supported by the limbs of a Y-shaped body with an extending hand group. The blade may be made from a single piece or form multiple segments with straight or curved cutting edges. The blade of blade segments may be fixed, such as by an adhesive, to a supporting carrier. Guard projections may extend from behind the cutting edge to beyond the cutting edge to reduce the likelihood of inadvertent contact with the blade edge while maintaining effective cutting action. In a method of use, the hair dressing device is manipulated so that the blade partly surrounds a cluster of hair strands and the device is moved to cut at least some of the strands of hair.

20 Claims, 6 Drawing Sheets

U.S. PATENT DOCUMENTS 5,979,056 A 11/1999 Andrews
D421,637 S * 3/2000 Stuckel ..... D22/118

FOREIGN PATENT DOCUMENTS

EP 0 925 885 A1 6/1999
EP 0 943 403 A1 9/1999
FR 2 673 878 9/1992
GB 2303362 12/1997
WO WO 95-35190 12/1995

* cited by examiner

HAIR CUTTING DEVICE

FIELD OF THE INVENTION

This invention relates to cutting devices and techniques, and to cutting and styling devices and associated techniques for styling and dressing hair. The invention particularly relates to a device having a generally curved edge for cutting and styling hair and methods of using such a device.

BACKGROUND TO THE INVENTION

Hair dressing techniques make use of conventional equipment such as scissors, comb and electric shaving or trimming devices. Much the same equipment is generally available and used by both professional hair dressers and home hair cutters alike. In some cases a device having a combined razor blade and comb structure may be used although the results are not always satisfactory.

SUMMARY OF THE INVENTION

It is an object of the present invention to provide an improved device for use in professional hair dressing, or at least to provide an alternative to existing devices. In general terms the invention provides a device having a blade or a combination of blades which provide a curved cutting edge or at least a multilinear approximation to a curved cutting edge.

Accordingly in one aspect the invention may broadly be said to consist in a hair styling device having a blade with a cutting edge, wherein the cutting edge comprises at least two limbs. Preferably the blade is interchangeable or replaceable, or comprises a set of blade segments which are arranged to provide the cutting edge. Preferably the cutting edge is formed by a combination of approximately nine straight blade segments which may overlap one another. Preferably the blade segments providing the cutting edge are collectively or individually interchangeable or replaceable.

Alternatively, the cutting edge is formed by a single curved blade.

Preferably the blade has a curved or multilinear cutting edge, and the cutting edge forms an approximate V or U-shape.

Preferably, the interior angle between tangents to the cutting edge at distal portions of the limbs is substantially zero.

Preferably, the blade is held in a body portion, the device having a handle portion which is part of or extends from the body portion, and further, the body portion includes two limbs forming an arc, the blade being accommodated and supported by the limbs, and yet further, the body portion and the handle portion form an approximate Y shape.

In a second aspect the invention may broadly be said to consist in a blade for a cutting device, the blade having two blade limbs connected together at respective proximal ends in a fixed relationship on respective sides of a space for accommodating matter to be cut by the blade, the accommodating space having an open end between respective distal ends of the blade limbs and a closed end between respective proximal interconnected ends of the blade limbs, each blade limb having at least one sharp cutting edge, the sharp cutting edges defining parts of the perimeter of the accommodating space.

In a third aspect the invention may broadly be said to consist in a blade assembly comprising the blade of the second aspect, wherein the blade is fixed to a substantially flat blade carrier, and at least a major portion of the blade carrier lies substantially outside the perimeter of the accommodating space.

In a fourth aspect the invention may broadly be said to consist in a blade support for a cutting device, the blade support comprising a grip and two limbs, wherein the two limbs are connected together at respective proximal ends in a fixed relationship on respective sides of a space for accommodating matter to be cut by the cutting device, the accommodating space has an open end between respective distal ends of the limbs and a closed end between the respective proximal interconnected ends of the limbs, each limb has a slot, the slots are substantially co-planar and open towards the accommodating space, and the two interconnected limbs are unitary with, or attached to, the grip in a fixed relationship.

In a fifth aspect the invention may broadly be said to consist in a cutting device comprising the blade support of the fourth aspect and the blade of the second aspect, the blade being located, and removably retained, in the slots of the blade support.

In a sixth aspect the invention may broadly be said to consist in a method of styling hair on a human head comprising:

raising a cluster of strands of hair from the head, addressing the cluster with a cutting instrument having an at least approximately curved cutting edge having at least two limbs, and moving the instrument relative to the cluster to cut at least some of the strands.

The invention may also broadly be said to consist in any alternative combination of parts or features here described or shown in the drawings. All equivalents of these parts or features are included.

BRIEF DESCRIPTION OF THE DRAWINGS

Preferred embodiments of the invention will be described with respect to the drawings, of which.

DETAILED DESCRIPTION OF THE PREFERRED EMBODIMENTS

Referring to these drawings it will be appreciated that a hair dressing device can be implemented in many forms within the scope of the invention. The device can take a wide range of shapes and may be used in a wide variety of ways. This description is given by way of example only. Details relating to hair cutting, styling or other dressing processes will be well known to a skilled reader and need not be given here. References herein to the styling and dressing of hair are to be understood as including operations involving the cutting of at least some individual strands of hair.

Figure 1:
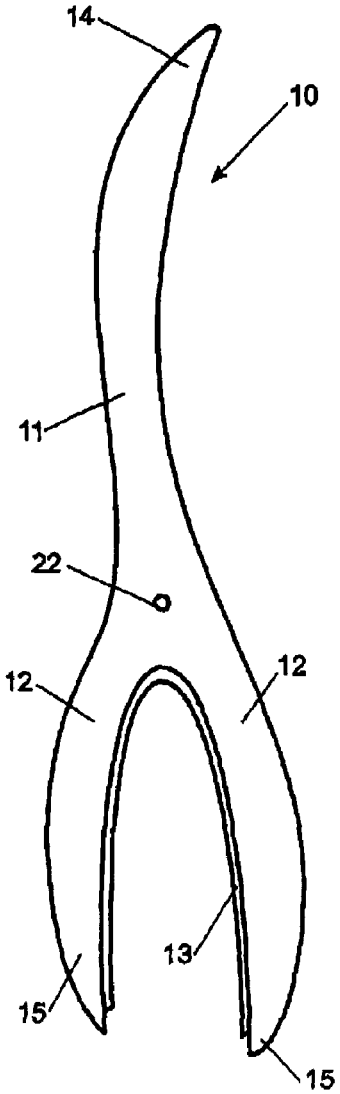
FIGS. 1, 2 and 3 are respective plan, side and end views of a hair dressing device.
Figure 2:
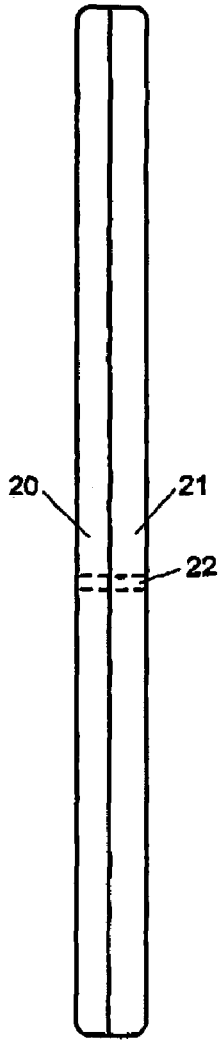
Figure 3:
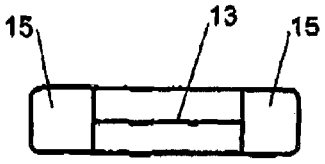

FIGS. 1, 2 and 3 show a hairdressing device 10 approximately to scale. The device in this example is a handle part with a generally Y-shaped form including a hand grip 11 and a pair of limbs or arms 12 which hold a cutting component 13. The arms are integral with the handle for simplicity of design although a wide range of more complex structures are clearly possible. One end 14 of the hand grip is asymmetrically tapered for a generally aesthetic effect, as are the ends 15 of each arm. The hand grip 11 is shaped to facilitate easy hand held operation of the cutting device and particularly control of the orientation and movement of the device. The cutting component 13 is a single curved blade having a generally U-shaped form with a sharpened cutting edge along the inside curve. The cutting component is retained by the arms 12 with the sharpened edge thereof exposed between the arms.

The handle part may be made by any suitable process, for example by machining, casting, injection moulding or other moulding techniques, and from any suitable material, for example from aluminium or other metals, or from thermosetting plastics. Where a thermoplastic is used, the plastic may be loaded with metal particles so that the moulded handle part can be metallised or electroplated, for example with chromium.

The general utility of the device may be enhanced by including a comb, not shown, on an outside part of one arm.

The general shape of the device allows universal application to left or right handed use by left or right handed operators.

The hand grip and the limbs or arms of the hair dressing device preferably have a simple two part structure provided by a pair of mirror image halves 20, 21. These may be fixed together in a variety of ways, such as by a screw or other form of fastener through an aperture 22, or by co-operating clasps provided on the two mirror image halves 20, 21. The cutting component 13 is installed within a slot provided by a rebate 40 on part 21, and has apertures 41, 42 which engage lugs on the arms 12.

The cutting component is installed by separating the mirror halves of the two part structure. A structure of this kind enables relatively easy removal and replacement of the cutting component. Many simple or sophisticated systems for attaching and replacing the cutting component are possible in commercial devices. In practice the blade might need to be replaced after 5 to 10 hair cutting jobs have been performed on normal hair.

Figure 5:
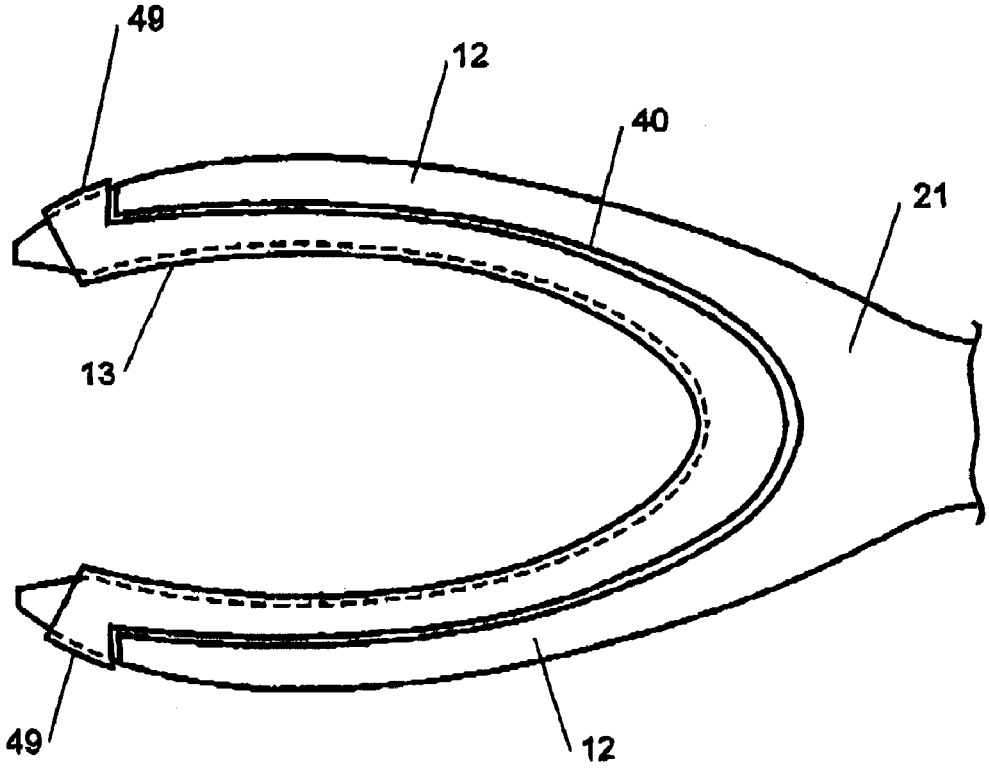
FIG. 5 is a plan view of part of one half of a cutting device showing an alternative arrangement for retention of the blade.

In an alternative arrangement, shown in FIG. 5, the blade is retained by its inherent resilience between the arms 12 of a handle part of a cutting device. In this arrangement the overall outside shape of the blade is made re-entrant: i.e. the overall width of the blade, measured in the plane of the blade, is made slightly larger midway between the distal tips and the base of the blade than at a position nearer the tips of the blade. The rebate 40 is shaped similarly to co-operate with the outer shape of the blade. The distal tips of the blade arms can be squeezed together slightly so that the blade can be inserted into the rebate without separating the mirror halves of the handle part, or into an equivalent slot in a unitary handle part. When released, the blade expands by its own resilience to bear against the rebate or slot so that the blade is positively located and retained in the rebate in the arms of the handle part.

Removal of the blade 13 from the limbs 12 is a simple reversal of the installation procedure. The outer ends of the arms of the blade are squeezed together to reduce the maximum width of the blade to less than the width between the base of the rebate or slot at the outer ends of the arms of the handle part so that the blade can be withdrawn. The outer edge of the blade can be provided with respective extensions 49 in the vicinity of the distal ends of each of the blade arms. The extensions extend beyond the outer perimeter of the limbs when the blade is installed in the rebate or slot so that pressure can be conveniently applied to the extensions, for example by thumb and forefinger, to squeeze the blade arms together when the blade is being inserted or removed.

Figure 4:
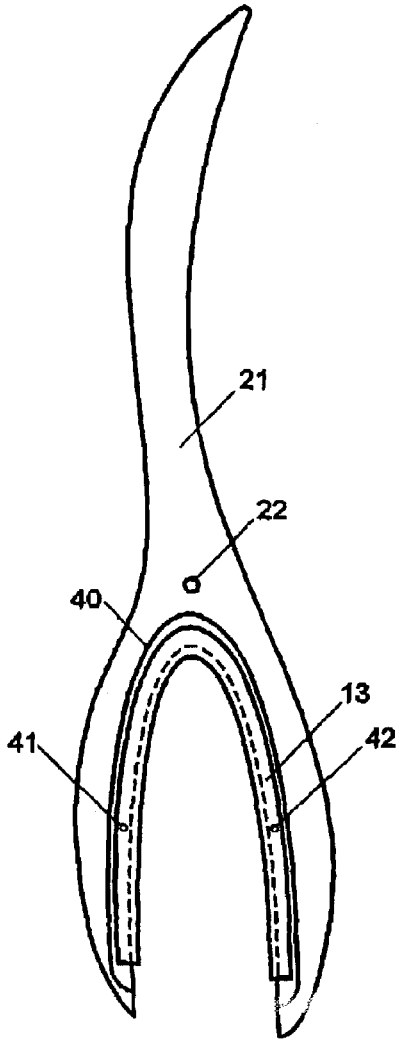
FIG. 4 is a plan view of one half of the device with a curved blade in place.

The cutting component 13 shown in FIGS. 1, 3 and 4 is a single piece, flat blade with a sharpened cutting edge, preferably like the sharpened edge of a conventional razor blade, on the inside of the generally U-shaped curve. That is, the cutting edge of the blade is a generally U-shaped curve. The blade may be fixed to, and supported on, a carrier, not shown. The carrier can be accommodated in the slot or rebate with the cutting edge exposed along the inside edge of the U-shaped space between the limbs.

The blade can be provided as a series of blade segments, the series providing a generally U-shaped blade edge. The segments may be curved or may be straight edges. The segments are attached, for example by a glue or adhesive, to a U-shaped blade carrier.

Figure 6:
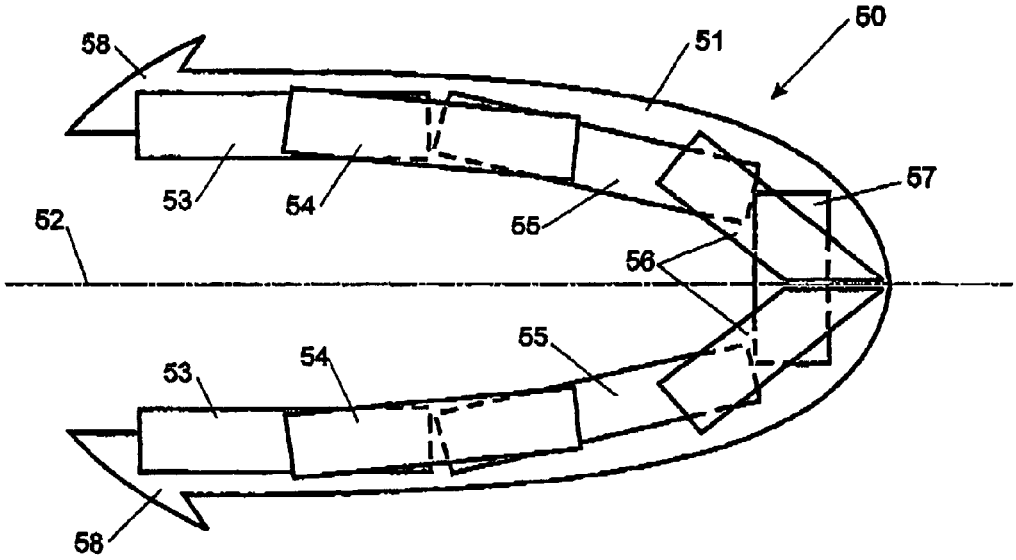
FIG. 6 is a plan view of a cutting component formed from multiple straight blades.

FIG. 6 shows a cutting component 50 formed by an assembly of straight blade segments on a carrier 51. The assembly is generally symmetrical about a centre line 52 to form a preferred overall U-shaped as mentioned above. Nine blade segments have been used in this example although assemblies involving smaller or great numbers are also feasible. For example, a version with two blade segments implements a generally V-shaped cutting edge. Other examples include from 3 up to 17 or more blade segments.

Blade segments 53, 54, 55 on each arm or side near the opening of the assembly may be more widely spread than blade segments 56, 57 near the base of the U-shape in order to achieve an effective change in curvature around the U-shape. A combination of blade segments having individually straight or possibly curved edges is called 'multi-linear' in this specification. The blade segments may be permanently, removably or even interchangeably attached to the carrier, depending on whether or not the assembly is intended to be disposable. Where the blade segments are permanently attached to the carrier they can be attached by a glue or adhesive.

Figure 7:
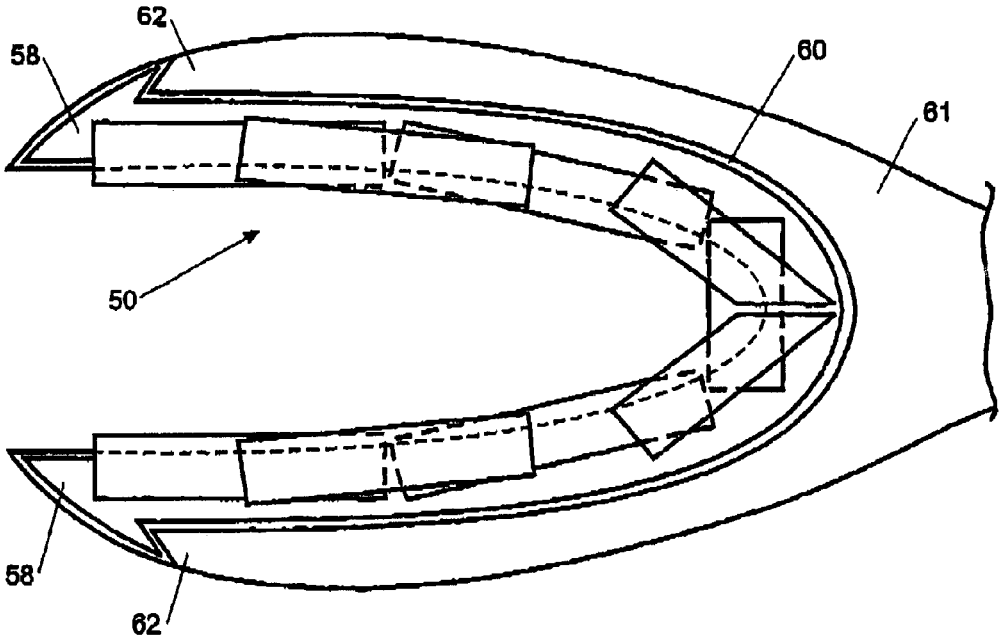
FIG. 7 is a plan view of the cutting component shown in FIG. 6 in place on a hair dressing device (shown only in part)

FIG. 7 shows the cutting component 50 fitted to a rebate 60 in one half of a hand grip and blade support part 61 (shown only in part) of a hair dressing device. In this case the cutting component is fastened within the arms of the device by way of end portions 58 of the blade assembly. Each end portion engages a corner 62 on a respective arm and thereby holds the cutting component firmly in place, generally through friction caused by a close fit with the other half of the part 61. Once again, a wide variety of components and systems for holding the cutting component in place is envisaged in practice. The entire hair dressing device might be disposable, or the blade edge intended to be resharpened without removal of the blade from the handle and blade support part, in which case the cutting component and the two halves of the handle and blade support part could be fixed together permanently or made as a unitary part.

Adjacent blade segments may overlap as shown in FIGS. 6 and 7 or may be juxtaposed end to end in a single plane. In this latter arrangement, which is not shown in the Figures, any tendency for material being cut to be caught or snagged at the junctions between adjacent blade segments may be reduced by covering the junctions by projections as will be discussed below.

The assembly of blade segments and the supporting carrier may be removably retained in a rebate in the handle part as discussed above in relation to the embodiments shown in FIGS. 1 to 5. The assembly may be respectively inserted or removed by being slid directly into or out of the rebate or slot in the handle part without separation of the handle part into half handle parts. This is particularly suitable if the assembly is provided with a re-entrant outer peripheral shape, in which case the distal ends of the assembly arms are squeezed slightly together to allow insertion and removal. Alternatively, the assembly may be respectively inserted or removed by first separating the handle half parts.

The use of the removably retained blade or blade assembly allows the cutting device to be used with interchangeable or replaceable blades and blade assemblies. The blade and blade assemblies can be removed for resharpening and reuse or can be simply discarded and replaced.

The overall shape of the cutting edge of the blade or blade assembly, whether provided as a single piece blade, or by multi-linear segments, may be generally U-shaped as already described above, or generally V-shaped. That is the blade may comprise two limbs with or without a third base portion linking the proximal ends of the limbs. In either case the two limbs of the blade encompass a space in which hair about to be cut, styled or dressed may be accommodated.

References herein to U-shape include part or semi oval shapes, or part or semi elliptical shapes, in addition to other shapes. References herein to U-shapes and V-shapes include, in addition to other shapes, U-shapes and V-shapes where the interior angle between two tangents to the shape is less than 45 degrees, and preferably substantially zero degrees. For example, in at least one embodiment of the cutting device, the interior angle between respective tangents to the outer or distal ends of the U-shaped cutting edge is about zero degrees, i.e. the tangents are approximately parallel.

A cutting edge is provided along the inside edge of the U or V-shaped blade. As discussed above, the cutting edge may be provided by a unitary blade or by segments with straight or curved cutting edges that combine to provide the U or V shape. In addition, the cutting edge may be continuous as already shown, or discontinuous i.e. the U or V-shaped cutting edge may be provided as a series of spaced apart cutting edges.

Figure 8:
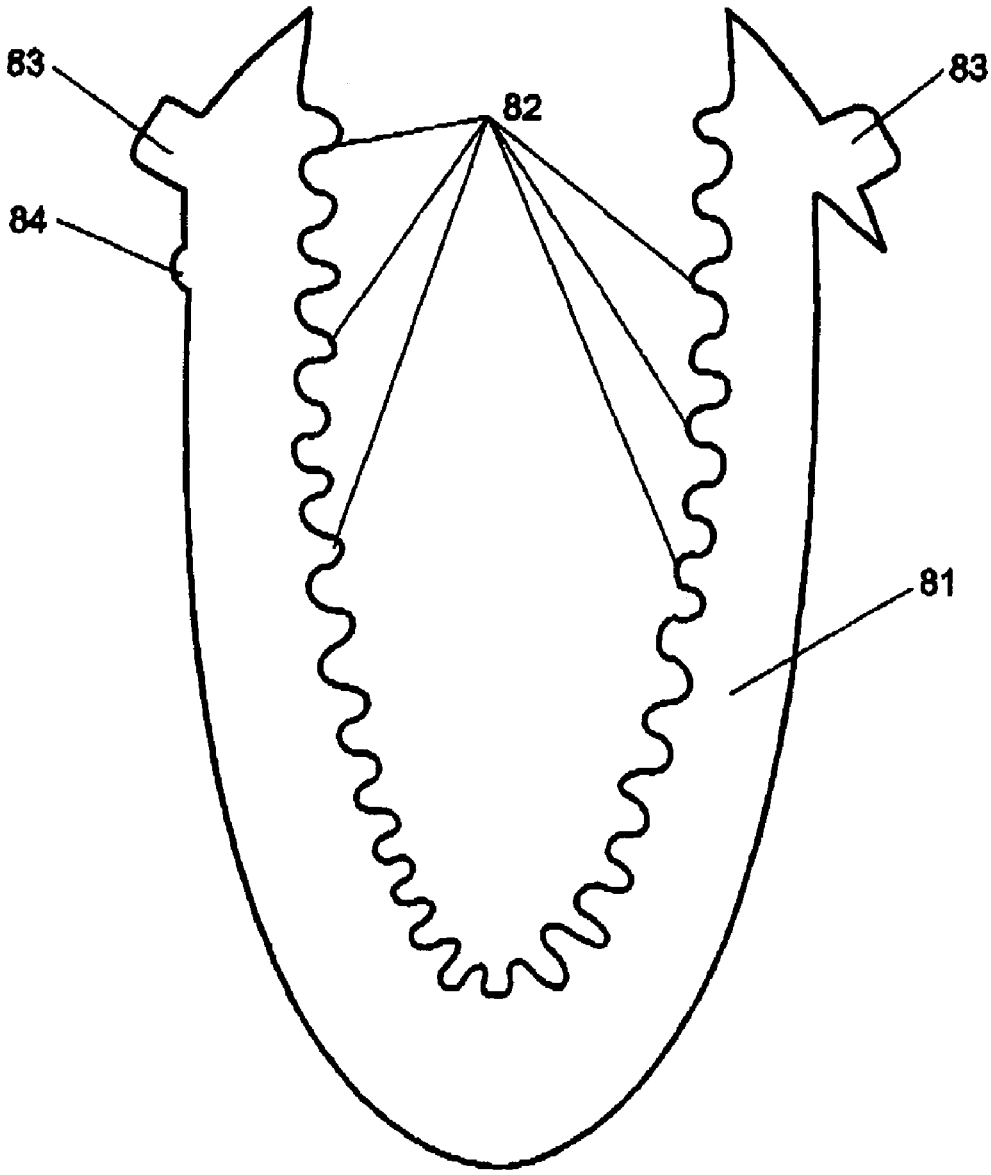
FIG. 8 is a plan view of a carrier component with guard projections.

FIG. 8 shows a carrier component 81 with a series of spaced apart guard projections 82. The carrier supports a blade or blade segments (not shown) when attached to the carrier. The projections effectively divide the sharpened edge of a single piece blade into a discontinuous cutting edge. The guard projections extend beyond the cutting edge into the accommodating space between the limbs of the blade. The projections act as a guard, reducing the likelihood of inadvertent contact with the cutting edge of the blade while maintaining a useful cutting performance of the device. Where the blade is provided as a series of blade segments, the carrier projections can be conveniently located at the junctions between adjacent segments to minimise any likelihood that material being cut can be caught or snagged between adjacent blade segments at their junction.

The blade carrier of FIG. 8 also includes extensions 83 which function in the manner described above in relation to the similar extensions 49 shown in FIG. 5. When the carrier is installed, the extensions project beyond the outer perimeter of the support and handle part so that pressure may be applied across the blade carrier to facilitate its installation and removal.

The blade carrier of FIG. 8 also includes a projection or detent 84 on the outer edge near the distal end of one of the limbs. This detent provides the blade carrier with a re-entrant shape, as already discussed, and engages a complementary shape in the slot or rebate of the handle part to retain the blade carrier in the handle part. Detents can be provided on both limbs.

Figure 9:
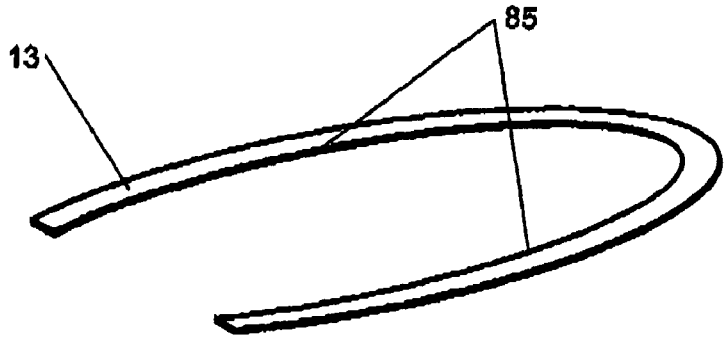
FIG. 9 is a perspective view of a flat blade.

FIG. 9 shows a perspective view of the substantially flat blade 13 as described above. When used in the embodiment described above, the plane of the blade is aligned with the general plane of the arms of the handle part which supports the blade. The cutting edge 85 of the blade is along the inner edge of the blade. The two blade limbs are co-planar with respective sharpened edges opposing across the gap between the blade limbs.

Figure 10:
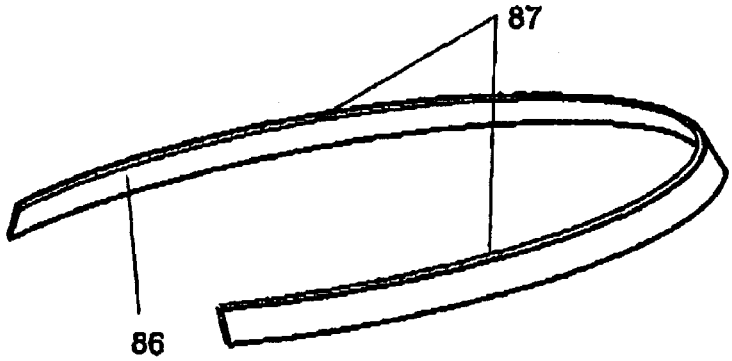
FIG. 10 is a perspective view of a sloping blade.

FIG. 10 shows a perspective view of another blade 86, having an alternative angled configuration. The angled blade can be formed from an initially flat blade piece with a splayed open or wide U-shape having a sharpened edge on the inside edge of the splayed arms of the wide U-shape. When the arms of the splayed open U-shape are brought together the blade provides the required U-shaped cutting edge 87 when the blade is curved into a narrow U-shape. Each portion of the length of the blade is angled to the general plane of the curved blade.

Figure 11:
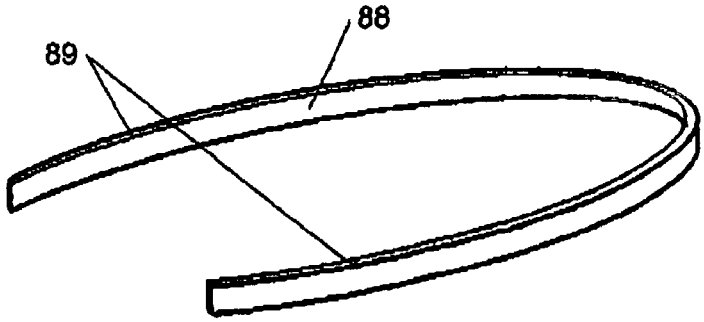
FIG. 11 is a perspective view of a perpendicular blade, and FIGS. 12, 13 and 14 indicate a device in use.

FIG. 11 shows a perspective view of yet another blade 88, having an alternative perpendicular configuration. The angled blade can be formed from an initially flat blade piece with a substantially straight sharpened edge which provides the generally U-shaped cutting edge 89 when the blade is curved into the required U-shape. Each portion of the length of the blade is substantially perpendicular to the general plane of the curved blade.

The blade may be attached to a unitary handle part by being embedded in or moulded with the handle part to provide a unitary cutting device. The handle part can be made from a suitable moulding material, for example a thermoplastic. The blade of such a unitary cutting device can be re-sharpened without removal from the handle part. Alternatively, the device can be treated as disposable and discarded when the cutting edge is no longer sufficiently sharp for its intended use.

Unitary cutting devices in which the blade is embedded or moulded into the handle part are particularly applicable to cutting devices with non-planar blade arrangements as discussed above, these blade arrangements not being directly amenable to retention in a linear rebate or slot.

Figure 12:
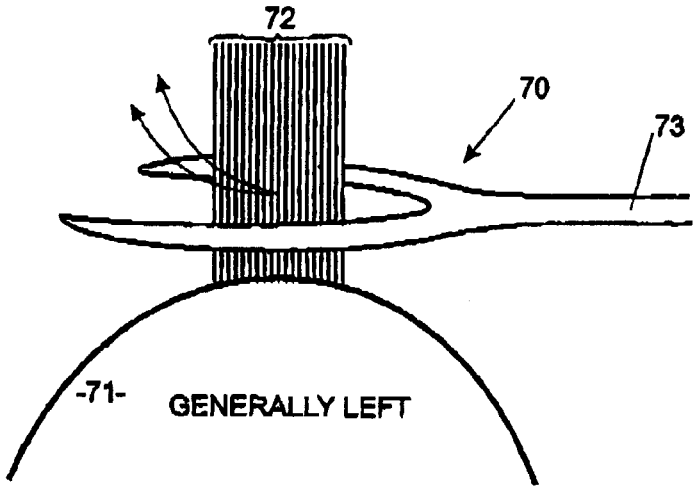
Figure 13:
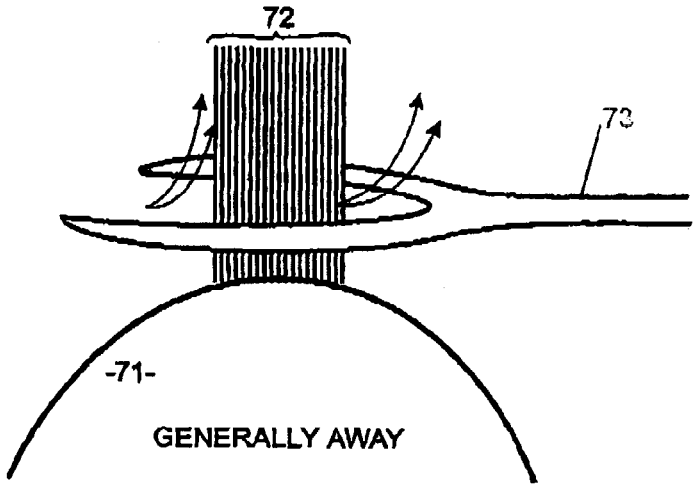
Figure 14:
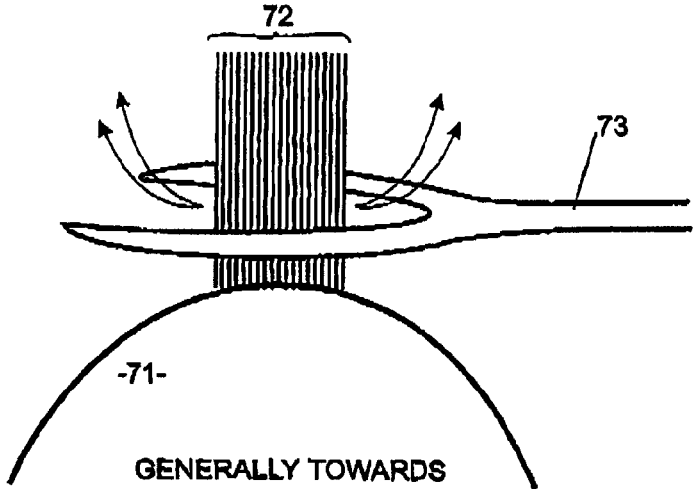

FIGS. 12, 13 and 14 show a hair dressing device 70, with a grip or handle 73, in use cutting hair on a human head 71. The device has a generally curved cutting component or blade, such as one of those described above, which enables considerable flexibility on the part of a hair dresser. There may be three or more main modes or directions in which the device may be used, with a range of movement possible to achieve different styling effects in and between each mode. The effects include texturing, feathering, layering, slithering, cutting, fullness, and jagged uneven ends to clusters of hair. In general, these effects are achieved by moving the device at a constant angle away from the head, or in a path along which the angle changes, such as an arc.

In FIGS. 12, 13 and 14 strands of hair forming a cluster 72 have been raised from the head and addressed by the device in preparation to cut at least some of the strands. Three main and generally mutually perpendicular directions of movement for cutting have been indicated with respect to the page of these figures, namely left, away and towards the viewer. When moved in any of these three directions, the curved cutting component or blade will make contact with the cluster of hair when the handle 73 is held to the right. In each case the device may be rotated about the general axis of the handle 73 and/or about an axis perpendicular to the page of FIGS. 12, 13 and 14, and thereby held at, or varied over, a range of angles with respect to the head, from generally horizontal to almost vertical. The cutting device may then be moved in any combination of the three directions noted above to perform a cutting or styling effect. A horizontal angle produces an approximately common length to all of the strands in the cluster, while an angle towards vertical produces a range of lengths, for example longer towards the end of the movement.

It will be seen that the device enables flexibility by allowing a hair dresser to cut a cluster of hair in a range of different ways, simply by repositioning or reorienting the blade from a given starting position. Repeatedly cutting clusters of hair during a hair dressing job produces one or more of the desired effects mentioned above.

The term "comprising" as used in this specification and claims means "consisting at least in part of," that is to say when interpreting statements in this specification and claims which include that term, the features, prefaced by that term in each statement, all need to be present but other features can also be present.

The invention claimed is:

1. A hair cutting device adapted for cutting hair on a human head, the hair cutting device comprising a blade and a blade support, wherein;

the blade support comprises a hand grip portion and two limb portions, proximal ends of the two limb portions are joined in a fixed relationship to one another and to the hand grip portion, and the two limb portions lie respectively along opposite elongate sides of an open-ended elongate space for accommodating hair to be cut by the hair cutting device;

the blade comprises two blade limbs which are respectively supported by the limb portions of the blade support with the blade limbs lying respectively along the opposite sides of the open-ended elongate space;

the blade presents an inwardly-directed cutting edge which extends along the opposite elongate sides of the open-ended space in a substantially U-shaped curve around the open-ended space; and further comprising a series of projections each of which projects inwardly from the blade cutting edge into the open-ended space between the blade limbs, the projections being spaced apart along the cutting edge.

2. A hair cutting device as claimed in claim 1, wherein the blade has a continuous cutting edge.

3. A hair cutting device as claimed in claim 1, wherein the hand grip portion is an elongate handle and both the blade support limb portions extend from one end of the elongate handle.

4. A hair cutting device as claimed in claim 3, wherein the blade support limb portions and the elongate handle together form a Y-shape.

5. A hair cutting device as claimed in claim 1, wherein the blade is removably attached to the blade support and is replaceable.

6. A hair cutting device as claimed in claim 1, wherein the blade comprises individual blade segments arranged serially along the U-shaped curve.

7. A hair cutting device as claimed in claim 6, wherein adjacent blade segments overlap one another.

8. A hair cutting device as claimed in claim 6, wherein the blade segments are collectively or individually interchangeable or replaceable.

9. A hair cutting device as claimed in claim 6, wherein the projections are respectively located at junctions between adjacent blade segments.

10. A hair cutting device as claimed in claim 6, wherein the blade comprises at least three individual blade segments arranged serially along the U-shaped curve.

11. A hair cutting device as claimed in claim 10, wherein each blade segment has a straight cutting edge.

12. A hair cutting device adapted for cutting hair on a human head, the hair cutting device comprising a blade and a blade support, wherein;

the blade support comprises a hand grip portion and two limb portions, proximal ends of the two limb portions are joined in a fixed relationship to one another and to the hand grip portion, and the two limb portions lie respectively along opposite elongate sides of an open-ended elongate space for accommodating hair to be cut by the hair cutting device;

the blade comprises two blade limbs which are respectively supported by the limb portions of the blade support with the blade limbs lying respectively along the opposite sides of the open-ended elongate space;

the blade presents an inwardly-directed cutting edge which extends along the opposite elongate sides of the open-ended space in a substantially U-shaped curve around the open-ended space; and the blade is attached to a U-shaped blade carrier which is supported by the blade support to provide support to the blade.

13. A hair cutting device as claimed in claim 12, wherein the blade carrier and the attached blade are an assembly which is removably attached to the blade support and is replaceable.

14. A hair cutting device as claimed in claim 12, wherein the hand grip portion is an elongate handle and both the blade support limb portions extend from one end of the elongate handle.

15. A hair cutting device as claimed in claim 14, wherein the blade support limb portions and the elongate handle together form a Y-shape.

16. A hair cutting device as claimed in claim 12, wherein the blade comprises individual blade segments arranged serially along the U-shaped curve.

17. A hair cutting device as claimed in claim 16, wherein adjacent blade segments overlap one another.

18. A hair cutting device as claimed in claim 16, wherein the blade segments are collectively or individually interchangeable or replaceable.

19. A hair cutting device as claimed in claim 16, wherein the blade comprises at least three individual blade segments arranged serially along the U-shaped curve.

20. A hair cutting device as claimed in claim 19, wherein each blade segment has a straight cutting edge.

* * * * *